313-414 SR
1/6/87 OR 4,634,924

United States Patent [19]
Hernqvist

[11] Patent Number: 4,634,924
[45] Date of Patent: Jan. 6, 1987

[54] ELECTRON GUN HAVING CYLINDRICAL FOCUS LENS

[75] Inventor: Karl G. Hernqvist, Princeton Township, Mercer County, N.J.

[73] Assignee: RCA Corporation, Princeton, N.J.

[21] Appl. No.: 762,852

[22] Filed: Aug. 6, 1985

[51] Int. Cl.[4] ..... H01J 29/62; H01J 29/50; H01J 29/82

[52] U.S. Cl. ..... 313/414; 313/449; 313/457

[58] Field of Search ..... 313/414, 457, 449

[56] References Cited

U.S. PATENT DOCUMENTS

| | | | |
|---|---|---|---|
| 2,921,228 | 1/1960 | Farnsworth | 315/13 |
| 3,873,879 | 3/1975 | Hughes | 315/368 |
| 4,178,532 | 12/1979 | Fukuzawa et al. | 313/414 |
| 4,271,374 | 6/1981 | Kimura | 313/449 |
| 4,368,403 | 1/1983 | Lewis | 313/457 |
| 4,370,592 | 1/1983 | Hughes et al. | 313/414 |

FOREIGN PATENT DOCUMENTS

| | | | |
|---|---|---|---|
| 1762578 | 3/1978 | Fed. Rep. of Germany | 313/414 |

*Primary Examiner*—Palmer C. DeMeo
*Attorney, Agent, or Firm*—Eugene M. Whitacre; Dennis H. Irlbeck

[57] ABSTRACT

An inline electron gun for generating and directing three electron beams, a center beam and two side beams, along initially coplanar paths includes an electrostatic main focusing lens for focusing the electron beams. The main focusing lens is formed by two spaced electrodes, each having three separate inline apertures therein. A first of the main focusing lens electrodes includes a first cylindrical portion having a diameter larger than the sum of the diameters of the apertures therein. A second of the main focusing lens electrodes includes a second cylindrical portion having a diameter larger than the diameter of the first cylindrical portion of the first main focusing lens electrode. At least part of the first cylindrical portion of the first main focusing lens electrode is located within the second cylindrical portion of the second main focusing lens electrode. The largest component of the main focusing lens is established by the first and second cylindrical portions. Secondary components of the main focusing lens are established by adjacent apertures in the first and second main focusing lens electrodes.

3 Claims, 4 Drawing Figures

ELECTRON GUN HAVING CYLINDRICAL FOCUS LENS

The present invention relates to electron guns and, particularly, to a unitized inline electron gun having an enlarged cylindrical focus lens.

BACKGROUND OF THE INVENTION

An inline electron gun is one designed to generate or initiate preferably three electron beams in a common plane and direct those beams along convergent paths to a point or small area of convergence near the tube screen. In one type of inline electron gun, shown in U.S. Pat. No. 3,873,879, issued to R. H. Hughes on Mar. 25, 1975, the main electrostatic focusing lens for focusing the electron beams is formed between two electrodes, referred to as the first and second accelerating and focusing electrodes. These electrodes include two cup-shaped members having their bottoms facing each other. Three apertures are included in each cup bottom to permit passage of three electron beams and to form three separate main focusing lenses, one for each electron beam. In a preferred embodiment, the overall diameter of the electron gun is such that the gun will fit into a 29-mm internal diameter tube neck. Because of this size requirement, the three focusing lenses are very closely spaced from each other, thereby providing a severe limitation on focusing lens design. It is known in the art that, the larger the focusing lens diameter, the less will be the spherical aberration which restricts the focusing quality.

In addition to the focusing lens diameter, the spacing between focusing lens electrode surfaces is important, because greater spacing provides a more gentle voltage gradient in the lens, which also reduces spherical aberration. Unfortunately, greater spacing between electrodes beyond a particular limit (typically 1.27 mm) generally is not permissible because of beam bending from electrostatic charges on the neck glass penetrating into the space between the electrodes, which causes electron beam misconvergence.

In U.S. Pat. No. 4,370,592, issued to R. H. Hughes and B. G. Marks on Jan. 25, 1983, an electron gun is described wherein the main focusing lens is formed by two spaced electrodes. Each electrode includes a plurality of apertures therein, equal to the number of electron beams, and also a peripheral rim, with the peripheral rims of the two electrodes facing each other. The apertured portion of each electrode is located within a recess set back from the rim. The effect of this main focusing lens is to provide the gentle voltage gradient sought to reduce spherical aberration. Because of the asymmetrical shape of the peripheral rims of the two electrodes described in the patent, horizontal and vertical focus voltage components for the inner and outer guns are not the same. In the vertical direction, the center electron beam sees more of a slot and experiences more focusing action than do the side electron beams, whereat the focusing geometry is bounded, in part, by a circular arc. This is because the field penetrates the slot more easily than an inscribed circular boundary in the vertical direction. Likewise, the horizontal focusing component at the outer electron beams may be more active than at the center beam, because the field in the horizontal direction falls away more rapidly at the sides of the peripheral rims than within the center of the recess.

Although the above-cited patents disclose electron gun designs having decidedly improved performance over prior inline electron guns, it is desirable to further improve such gun designs to reduce the differential in strengths between the horizontal and vertical focusing fields and to enlarge the recesses in their focusing electrodes, thereby enlarging their main focusing lenses. Such enlargement of the recesses, however, is greatly limited by the design of the above-mentioned electron guns because of their use of two or four electrode support rods or beads. The present invention provides an electron gun structure having more uniform relative strengths between the horizontal and vertical focusing fields, and which provides an enlarged focus lens, utilizing standard support rods.

SUMMARY OF THE INVENTION

In accordance with the present invention, an electron gun for generating and directing three electron beams along paths includes an electrostatic main focusing lens for focusing the electron beams. The main focusing lens is formed by two spaced electrodes. A first of the main focusing lens electrodes includes a first cylindrical portion and a first apertured portion. The first apertured portion closes one end of the first cylindrical portion. The first apertured portion includes three apertures therein. A second of the main focusing lens electrodes includes a second cylindrical portion, having a diameter larger than the diameter of the first cylindrical portion of the first main focusing lens electrode, and a second apertured portion; the second apertured portion closes one end of the second cylindrical portion. The second apertured portion includes three apertures therein. At least part of the first cylindrical portion of the first main focusing lens electrode is located within the second cylindrical portion of the second main focusing lens electrode. One component of the main focusing lens is established by the first and second cylindrical portions. Other components of the main focusing lens are established by adjacent apertures in the first and second main focusing lens electrodes.

DETAILED DESCRIPTION OF THE PREFERRED EMBODIMENT

Figure 1:
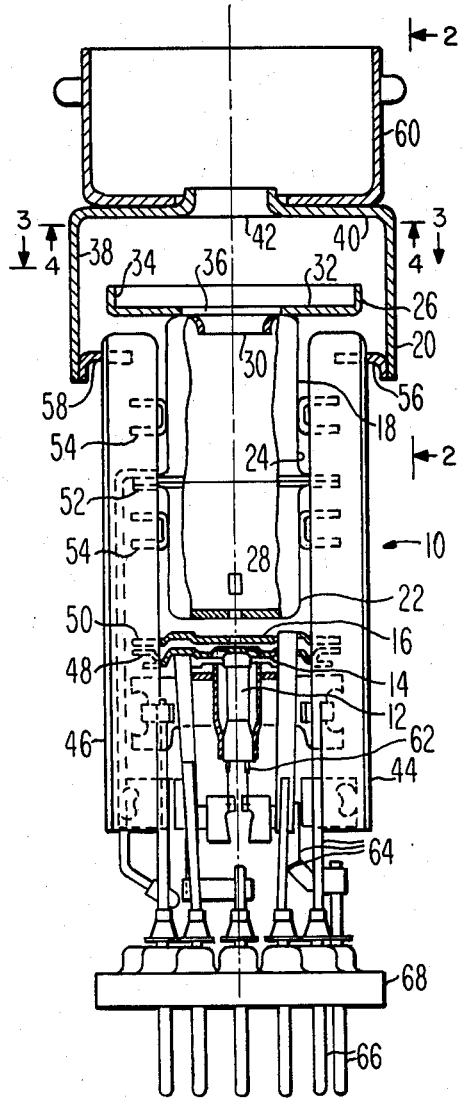
FIG. 1 is a side view, partly in axial section, of an electron gun embodying the present invention.
Figure 2:
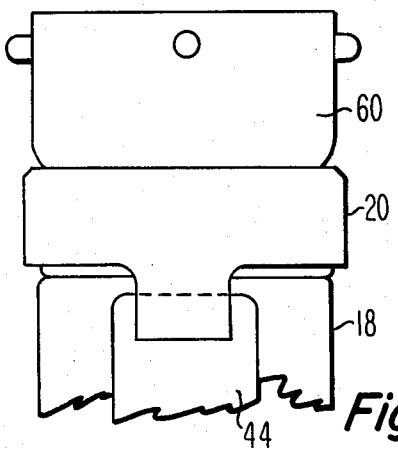
FIG. 2 is a bottom view of a portion of the electron gun taken at line 2—2 of FIG. 1.
Figure 3:
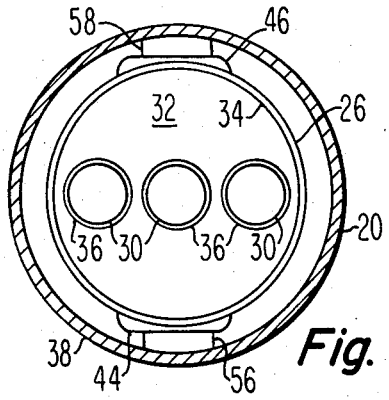
FIG. 3 is a cross-sectional view of the electron gun taken at line 3—3 of FIG. 1.
Figure 4:
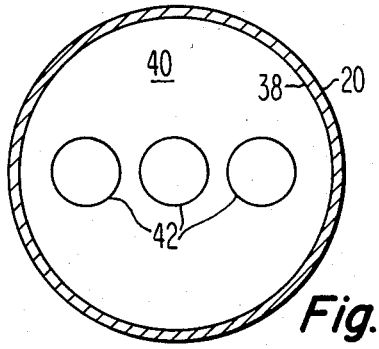
FIG. 4 is a cross-sectional view of the electron gun taken at line 4—4 of FIG. 1.

The details of a novel electron gun 10 are shown in FIGS. 1, 2, 3 and 4. The gun 10 comprises three equally spaced coplanar cathodes 12 (one for each beam), a control grid electrode 14 (G1), a screen grid electrode 16 (G2), a first main focusing lens electrode 18 (G3), and a second main focusing lens electrode 20 (G4), spaced in the order named. Each of the G1 through G4 electrodes has three inline apertures therein to permit passage of three coplanar electron beams.

The main electrostatic focusing lens in the gun 10 is formed between the G3 electrode 18 and the G4 electrode 20. The G3 electrode 18 is formed by two cup-shaped elements 22 and 24 and by a saucer-shaped element 26. The open ends of the elements 22 and 24 are attached to each other. The closed ends of the elements 22 and 24 each contain three inline apertures 28 and 30, respectively, with the apertures 28 in the element 22 that face the G2 electrode 16 being substantially smaller than the apertures 30 in the element 24 that face the G4 electrode 20. The element 26 includes an apertured disk-shaped bottom portion 32 and a cylindrical peripheral portion 34. The cylindrical portion 34 has a larger diameter than the sum of the diameters of the three apertures 30 in the element 24. The element 26 is attached to the closed end of the element 24 so that three apertures 36 in the bottom portion 32 are aligned with the three apertures 30.

The G4 electrode 20 comprises a large cup-shaped element having a cylindrical portion 38 and a disk-shaped base 40. The base 40 includes three inline apertures 42. The cylindrical portion 38 of the G4 electrode 20 is larger than the cylindrical portion 34 of the G3 electrode 18. The cylindrical portion 34 is located within the cylindrical portion 38 in a spaced, telescope-like fashion.

The electrodes are structurally interconnected by two electrically insulative support rods 44 and 46. Each of the electrodes includes support claws or other support elements which are embedded in the support rods. Preferably, the support rods 44 and 46 are of glass, which was heated, and, thus, the claws or members were embedded therein. The G1 grid electrode 14, the G2 grid electrode 16 and the G3 electrode 18 have either integral claws 48, 50 and 52, respectively, and/or U-shaped members 54 that extend outwardly from the respective electrodes to the inside portion of the support rods. However, the G4 electrode 20 has support members 56 and 58, attached to the interior surface thereof, that extend inwardly and are embedded in the outside portion of the support rods 44 and 46, respectively. Such attachment of the G4 electrode permits a larger diameter to be used for the G4 electrode than would be possible if the G4 electrode claws were embedded in the inside portions of the support rods.

Other parts of the electron gun 10 include: a shield cup 60 which is attached to the G4 electrode 20, heater coils 62 in each of the cathodes 12, and various electrical connections 64 between the heaters, cathodes and electrodes and external pins 66 which pass through a glass stem 68.

Some typical dimensions for a preferred electron gun 10, as described herein, are presented in the following table.

TABLE

| | |
|---|---|
| External diameter of element 26 of G3 electrode 18 | 19 mm |
| Length of cylindrical portion 34 of element 26 | 2.5 mm |
| External diameter of G4 electrode 20 | 23.8 mm |
| Length of major part of cylindrical portion 38 of G4 electrode 20 | 32.5 mm |
| Material thickness of element 26 and G4 electrode 20 | 0.75 mm |
| Spacing between bottom portion 32 of element 26 and base 40 of G4 electrode 20 | 8 mm |
| Diameters of apertures 30 and 42 in G3 and G4 electrodes | 5.25 mm |
| Anode voltage applied to G4 electrode 20 | 25K volts |
| Focus voltage applied to G3 electrode 18 | 7K volts |

The electron gun 10 can be assembled utilizing a standard procedure whereby the support rods 44 and 46 are heated and pressed against the claws of the electrodes. At the same time, the support members 56 and 58 are embedded in the outside surface of the rods. Thereafter, the assembly comprising the electrode 20 and shield cup 60 is welded to the support members 56 and 58.

The above-described design for the main focusing lens electrodes provides the largest electrodes possible in a given neck size without utilizing an internal neck coating for the electrodes. Because of the size and symmetry of the cylindrical portions of the electrodes, the relative strengths of the horizontal and vertical focusing fields are more uniform, and astigmatism is less, than in a gun having smaller nonsymmetrical electrodes. The present cylindrical lens design also differs from previous cylindrical lens designs, such as shown in U.S. Pat. No. 3,448,316, issued to Yoshida et al. on June 3, 1969, in that the cylindrical portions of the lens electrodes are closed by apertured portions. The apertured portions keep the beams separated and provide an individual focusing influence on each of the beams. If necessary, the size, shape and spacing of the apertures can be altered or tailored to solve particular design problems.

Although the preferred embodiment has been described with respect to an inline electron gun, it should be understood that the novel cylindrical main focus lens, with each main focus lens electrode having an apertured portion, can also be used in a delta electron gun.

What is claimed is:

1. In an electron gun for generating and directing three electron beams along paths, said electron gun including an electrostatic main focusing lens which is formed by two spaced electrodes, the improvement comprising a first of the main focusing lens electrodes including a first cylindrical portion and a first apertured portion, the first apertured portion closing one end of the first cylindrical portion, and the first apertured portion including three apertures therein, and a second of the main focusing lens electrodes including a second cylindrical portion having a diameter larger than the diameter of the first cylindrical portion of said first main focusing lens electrode, and a second apertured portion closing one end of the second cylindrical portion, the second apertured portion including three apertures therein, at least part of the first cylindrical portion of said first main focusing lens electrode being located within the second cylindrical portion of said second main focusing lens electrode, whereby one component of the main focusing lens is established by the first and second cylindrical portions, and other components of the main focusing lens are established by adjacent apertures in the first and second main focusing lens electrodes.

2. The electron gun as defined in claim 1, wherein said electrodes are interconnected by at least two insulative support rods, and said first main focusing lens electrode is supported from the inside of said rods and the second main focusing lens electrode is supported from the outside of said rods.

3. In an inline electron gun for generating and directing three electron beams, a center beam and two side beams, along initially coplanar paths, said electron gun including an electrostatic main focusing lens which is formed by two spaced electrodes, each electrode having three separate inline apertures therein, the improvement comprising a first of the main focusing lens electrodes including a first cylindrical portion having a diameter larger than the sum of the inline direction dimensions of the apertures therein, a second of the main focusing lens electrodes including a second cylindrical portion having a diameter larger than the diameter of the first cylindrical portion of said first main focusing lens electrode, at least part of the first cylindrical portion of said first main focusing lens electrode being located within the second cylindrical portion of said second main focusing lens electrode, and said electrodes being interconnected by at least two insulative support rods, said first main focusing lens electrode being supported from the inside of said rods and said second main focusing lens electrode being supported from the outside of said rods, whereby one component of the main focusing lens is established by the first and second cylindrical portions, and the other components of the main focusing lens are established by adjacent apertures in the first and second main focusing lens electrodes.

* * * * *